US005971240A

United States Patent [19]

Dequaine

[11] Patent Number: 5,971,240

[45] Date of Patent: Oct. 26, 1999

[54] ARTICLE OF MANUFACTURE, AN AMBIDEXTROUS HOLSTER, DETACHABLY REMOVABLE FROM A USERS HAND, FOR RETAINING REPELLENT SPRAY

[76] Inventor: Scott A. Dequaine, 1089 Oregon St., Green Bay, Wis. 54303

[21] Appl. No.: 08/977,041

[22] Filed: Nov. 25, 1997

[51] Int. Cl.[6] ..... A45F 5/00

[52] U.S. Cl. ..... 224/217; 224/218; 224/148.5; 2/160; 2/163; 222/175

[58] Field of Search ..... 224/191, 217, 224/218, 148.1, 148.4–148.7; 222/175; 2/158, 159, 160, 163

[56] References Cited

U.S. PATENT DOCUMENTS

| | | | |
|---|---|---|---|
| 1,685,808 | 10/1928 | French | 224/217 |
| 4,414,692 | 11/1983 | Dzierson et al. | 224/218 |
| 4,447,912 | 5/1984 | Morrow | 2/160 |
| 4,463,879 | 8/1984 | Des Voignes . | |
| 4,477,005 | 10/1984 | Martinez . | |
| 4,504,980 | 3/1985 | Butcher . | |
| 5,088,121 | 2/1992 | Wallace . | |
| 5,133,233 | 7/1992 | Erwin | 2/160 |
| 5,318,492 | 6/1994 | Quinn . | |
| 5,678,730 | 10/1997 | Fabek et al. | 222/175 |
| 5,875,945 | 3/1999 | Roach | 224/217 |

*Primary Examiner*—Gregory M. Vidovich
*Attorney, Agent, or Firm*—Recka & Joannes; Joseph M. Recka

[57] ABSTRACT

An ambidextrous, light weight, hand holster for repellent spray; the holster is made of a stretchable, elastic and porous fabric. The holster detachably retains and locates the repellent spray. Applicant's holster is disposed around the base of the fingers, from the first finger to the little finger, so as a user closes the hand, the thumb contacts the operating mechanism. The rotation of the users thumb, activates the operating mechanism, releasing the repellent spray. Finger encircling tubes, encircling the index and little finger towards the first knuckle, position the holster and prevent the rotation of the holster on the hand, as the spray is activated. The holster finger encircling tubes encircle the users index and little fingers; the two middle fingers are not simultaneously encircled by the tubes, allowing air to circulate within the holster.

6 Claims, 3 Drawing Sheets

ARTICLE OF MANUFACTURE, AN AMBIDEXTROUS HOLSTER, DETACHABLY REMOVABLE FROM A USERS HAND, FOR RETAINING REPELLENT SPRAY

BACKGROUND OF THE INVENTION

This invention relates to the field of hand mounted, ambidextrous, repellent spray holsters.

DESCRIPTION OF THE RELATED ART

Various types of repellent spray are available. The most common repellent sprays are pepper spray and tear gas. The repellent sprays are commercially available in pressurized aerosol containers.

Pressurized aerosol containers of repellent spray are designed to be carried in a purse, pocket, held in the hand, or in a belt holster.

For some users, such as joggers, no purse, pocket or belt is available. Hand carrying the repellent spray, over a long period of time, is difficult, due to perspiration, and muscle cramping from the effort to hold the repellent spray.

To be effective, the repellent spray should be instantly available, requiring the movement only of the thumb, to project the repellent spray. Various types of holsters have been developed.

SUMMARY OF THE INVENTION

It is an object of the invention, to provide a holder for a container of repellent spray, holding the repellent spray instantly available for use.

It is an object of the invention to locate the container of repellent spray, and its operating mechanism, in a defined location, adjacent to the thumb.

It is an object of the invention, to anchor the holster, by providing a bearing surface, along the side of the index finger, that will prevent the holster from rotating around the hand, as force is applied to the operating mechanism of the container, and from rotating around the hand, as the joggers arms are in motion.

It is an object of the invention to locate the holster, on the hand, away from the thumb, and within the narrow range of rotation of the thumb, to operate the spray.

It is an object of the invention to provide a holster that is useable on either hand. That is, the holster is ambidextrous, requiring only one holster for right handed, and left handed people.

It is an object of the invention to locate the spray, so as a user tightens his or her hand, the thumb contacts the operating mechanism, and the rotation of the thumb, serves to push in the operating mechanism, releasing the repellent spray.

It is an object of the invention to provide a device that does not require straps, buttons, or other retaining devices, that must be operated, to retain the holster on the users hand. It is an object of the invention to make a light weight holster, a holster that allows the user to manipulate keys, a pen, or other objects, and do hand/finger movements, while the holster is mounted on the users hand.

In the preferred embodiment, a holster, formed of a band of porous and stretchable fabric, is placed on a users hand, over the palm and back of the hand; a finger retaining section is formed in the band, by three finger encircling tubes, as part of the holster; the holster extends over the palm, short of the thumb; a repellent spray retaining strap is affixed to the palm of the holster. A container of a repellent spray, operable by applying force to the operating mechanism of the container, by a users thumb, is retained within the retaining strap, adjacent to the thumb.

DESCRIPTION OF THE PREFERRED EMBODIMENT

Figure 1:
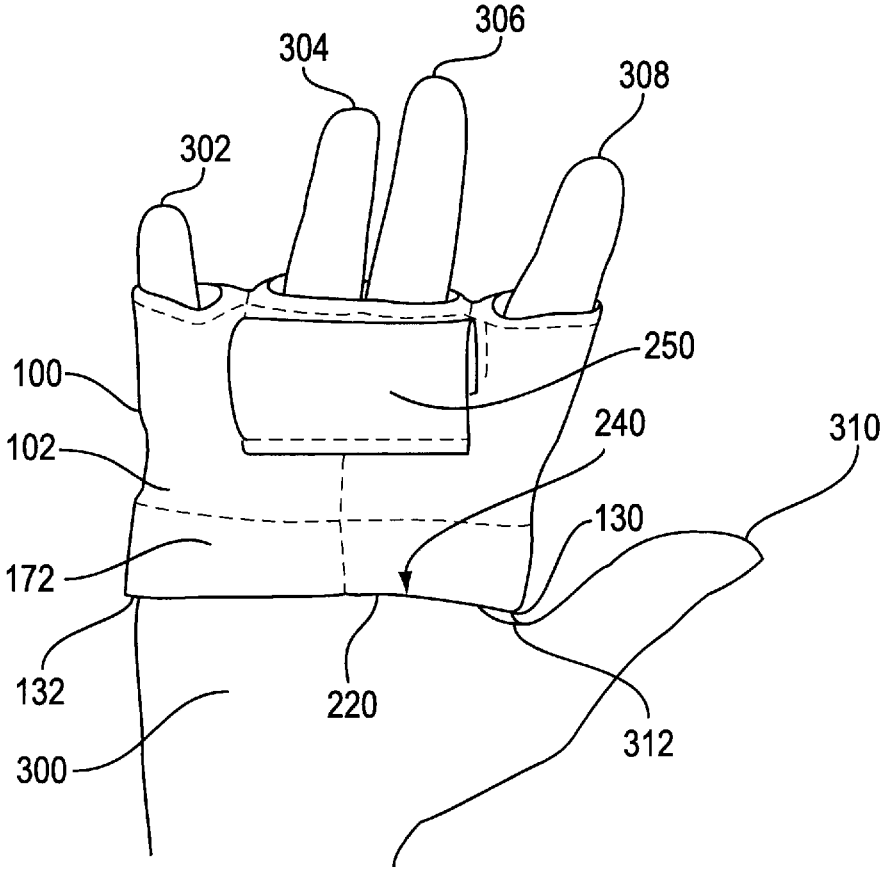
FIG. 1 is a bottom view of the holster, mounted on a users hand, with attached repellent spray retaining strap.

Referring to FIG. 1, important aspects of the invention, are; the holster 100 is ambidextrous; the holster 100, is formed by a band of stretchable, elastic-like and porous fabric 102. Holster 100 is pulled on the user's hand 300, over the user's fingers 302, 304, and 306 and 308, and restrained by the webs of the fingers of the user's hand at the metacarpophalangeal joints.

Figure 4:
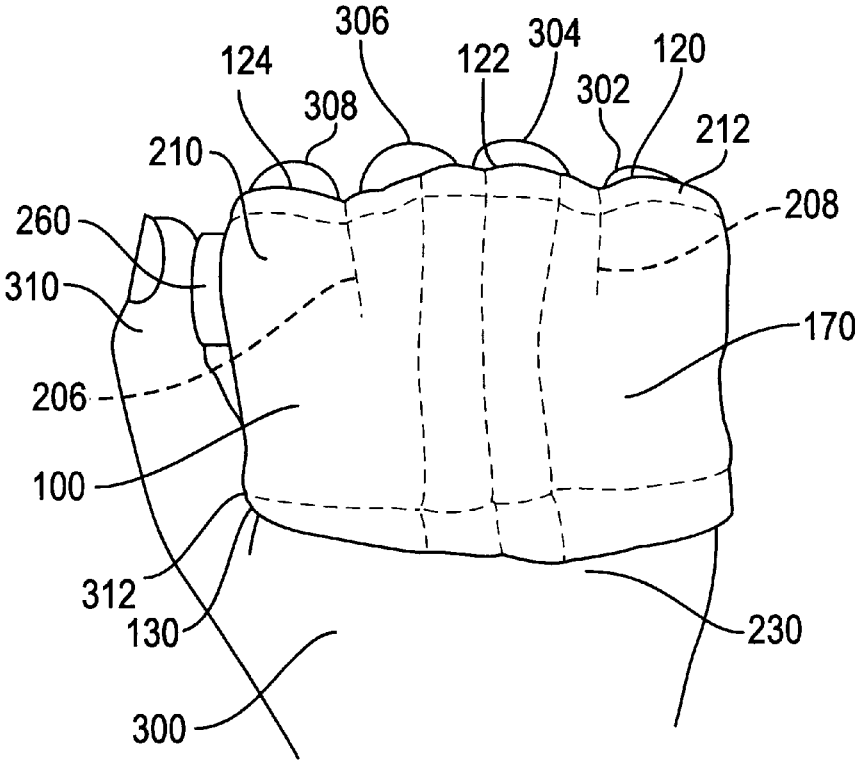
FIG. 4 is a top view of the holster mounted on a users hand.

The location of the container of repellent 270 is shown best in FIG. 1 and FIG. 4, between proximate the metacarpophalangeal joint of the fingers, and the proximal interphalanged joint of the fingers.

The holster 100 is slid over and around the user's fingers 302, 304, 306 and 308. The holster 100 is pulled on, until the user's index finger 308, and the user's little finger 302, are fully retained to the metacarpophalanged joint, extending to the proximal interphalanged joint, within tubes 210 and 212, and the middle finger and ring finger 304 and 306 are encircled by tube 211, best seen in FIG. 6.

The edge 130 of the holster 100 is pulled into contact with the web 312 of the user's thumb 310.

Figure 3:
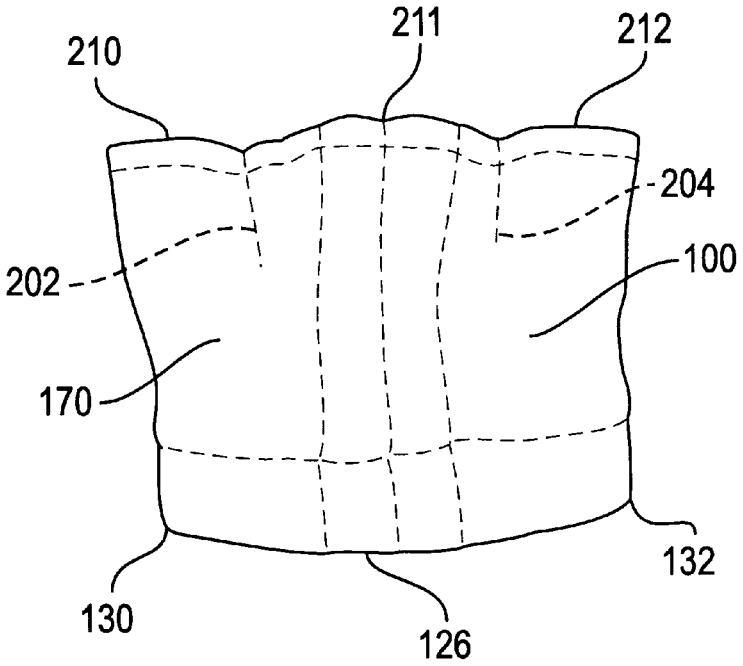
FIG. 3 is a top view of the holster.

The finger encircling tubes 210, 211 and 212 can be seen as formed by the stitching 202 and 204, in FIG. 3 and FIG. 4.

Figure 7:
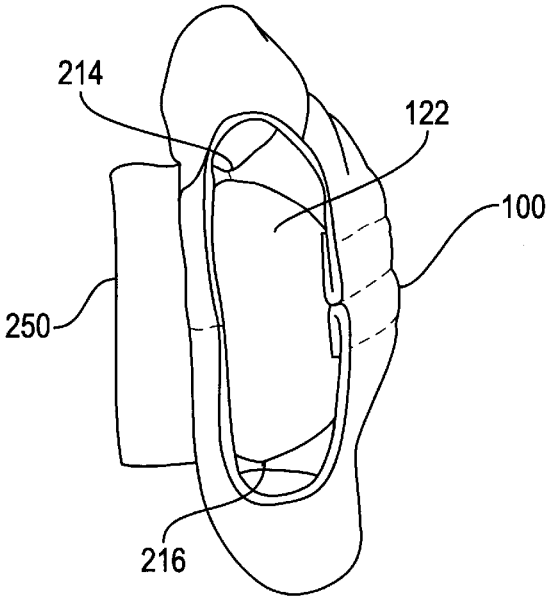
FIG. 7 is a back view of the holster.

The hand web contacting surface 214, and the hand web bearing surface 216, can be best seen in FIG. 7. Surfaces 214 and 216 bear up against the user's finger webs, at the metacarpophalangeal joint and position the holster 100.

The holster 100 is prevented from rotating, when force is applied to the operating mechanism of the repellent spray 260, or by the motion of a user's arm, by the holster 100 bearing against the user's index finger 308, which is held within index finger encircling tube 210.

The index finger encircling tube 210, and the little finger encircling tube 212, and the middle finger and ring finger encircling tube 211, are formed by sewing the top 170 of the holster 100 and the palm 172 of the holster 100, together.

Figure 2:
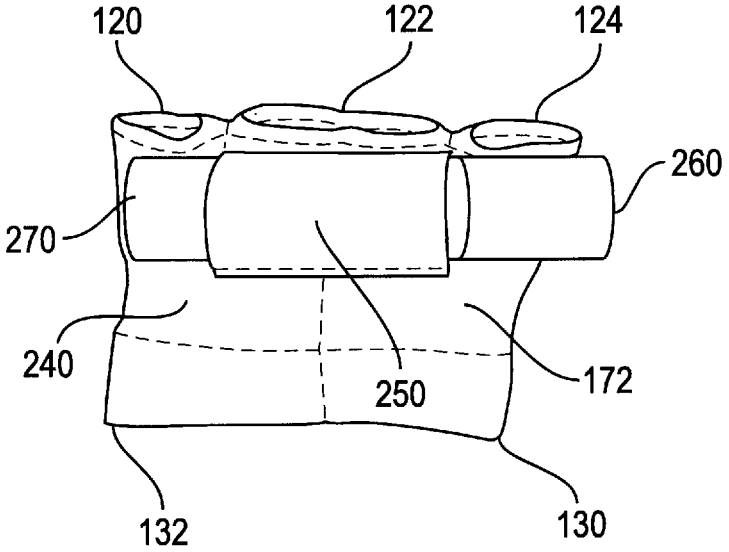
FIG. 2 is a bottom view of the holster, with container of repellent spray.

FIG. 2 is a bottom view of the holster 100, showing little finger exit hole 120, large center finger exit hole 122 for the middle finger and ring finger, and index finger exit hole 124; also shown are thumb web contact surfaces 130 and 132.

In the center of the holster 100, is mounted stretchable retaining strap 250, retaining a container of repellent spray 270, with operating mechanism of repellent spray 260, facing right under the thumb, as it would be facing on a right handed user, as best seen in FIG. 4.

FIG. 3 is atop view of holster 100, finger exit holes 120, 122, and 124, which are the exit ends of finger encircling tubes 210, 211 and 212, are at the top of holster 100. Grouped finger insertion hole 126, can be seen at the center bottom of the holster 100. Thumb web bearing surfaces 130 and 132 are shown. Stitching can be seen at 202 and 204; the stitching forms the finger encircling tubes 210, 211, and 212.

The length of the stitching 206 and 208, establishes how far finger encircling tubes 210, 211 and 212, allow the user's fingers 302, 304, 306, and 308, to extend out of the holster 100.

The stitching 202 and 204 forms finger encircling tubes 210, 211, and 212.

The index finger encircling tubes 210 and 212 prevent rotation of the holster 100 when pressure is applied by the user's thumb 310 against the operating mechanism 260 of the container of repellent spray 270.

FIG. 4 is a top view of holster 100, mounted on a right handed user's hand 300. The user's thumb 310 is shown bearing on the operating mechanism of the repellent spray 260.

The thumb web contacting surface 130, can be seen bearing against the web of the user's thumb 312.

As force is applied to operating mechanism 260, the index finger encircling tube 210, formed by stitching 202, bear against the user's index finger 308, preventing rotation of holster 100, around the user's hand 300, as pressure is applied to the operating mechanism 260.

Figure 5:
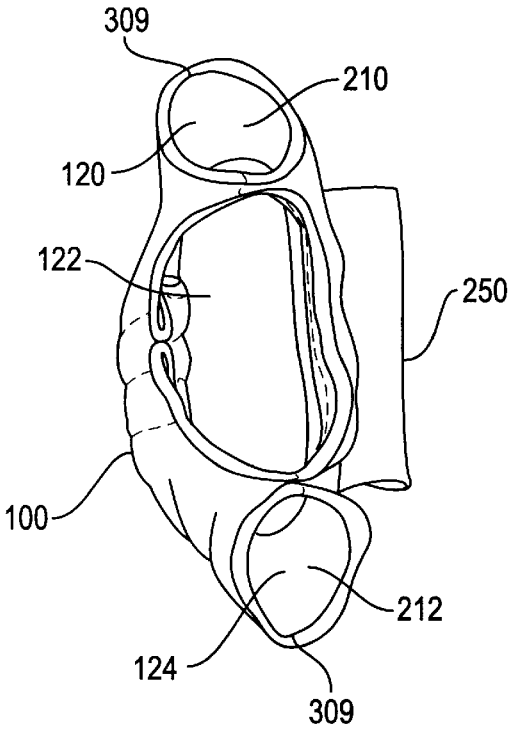
FIG. 5 is a front view of the holster, showing the index finger encircling tube, the tube encircling the two center fingers, and the little finger encircling tube.

FIG. 5 is a front view of the holster 100, showing three finger openings, or finger exit holes 120, 122, and 124.

Finger exit hole 120, is for either the little finger of a right handed user, or the index finger of a left handed user. Finger exit hole 122, is for the middle finger and ring finger of either hand. The middle finger and ring finger are held within finger encircling tube 211.

The finger exit hole 122, for the middle finger and ring finger, is larger than the opening for the index finger and little finger. Finger exit hole 122 provides for air circulation and freedom of movement of the middle finger and ring finger, and for ease in putting the holster 100 on.

The finger encircling tubes 210, 211, and 212 position the holster 100, in an ambidextrous fashion, and provide the anti-rotational surfaces that prevent the holster 100 from rotating around the palm, as the operating mechanism 260 is used.

Figure 6:
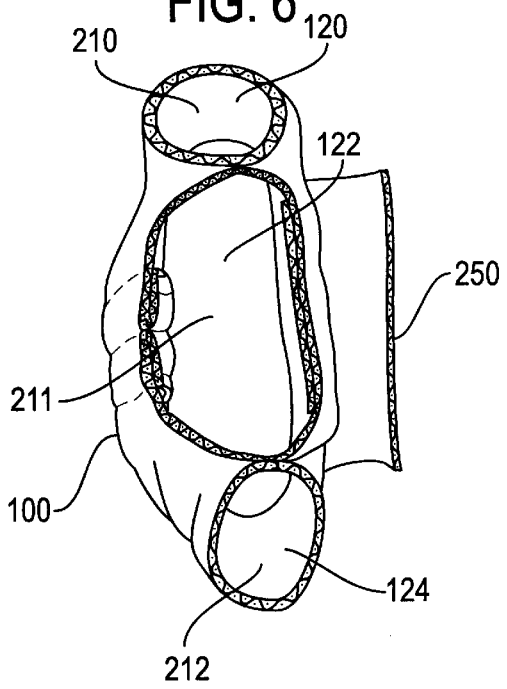
FIG. 6 is a front view of the holster, in section.

FIG. 6 is a section through the holster 100, finger exit holes 120, 122, and 124, can be seen, cut back to the finger/hand web bearing surfaces 214 and 216. A section is taken through the stretchable retaining strap 250.

FIG. 7 is a back view of the holster 100; the stretchable retaining strap 250 can be seen on the left, and the external surfaces of the holster 100, with the flared finger exit holes 120 and 124 at the top.

The center shows the large two finger exit hole 122, and the finger encircling tubes 210, 211, and 212.

The holster 100 extends across the palm 220 and across the back of a user's hand 230. The width 240 of the band 102, extends across the back of the user's hand 230, and the width 240 of the band 102, extends over the palm 220. The width is determined by measuring a substantial number of hands, and is sized so that the band 102, does not ride up the web 312 of the user's thumb 310. The width 240 of the band 102, is short of the user's thumb 310, so the holster 100 is ambidextrous. This holster does not encircle the thumb. The holster 100 can be put on either hand 300 and be operative.

As can be seen in FIG. 1, there are no detachable straps, buttons to operate, or other retaining devices, that must be operated to put the holster 100 on a user's hand 300 or to hold the container of repellent spray 270.

A stretchable retaining strap 250 is affixed to the palm 172 of the holster 100.

A container of repellent spray 270, comprising a body 272, and an operating mechanism 260, is removably placed in the stretchable retaining strap 250, so that the operating mechanism 260 is positioned under a user's thumb 310.

BEST METHOD

The advantage of the holster, is that the holster is light. The holster is ambidextrous.

The holster can be used by either right handed, or left handed users. The holster can be switched from one hand to the other, as the user fatigues.

The holster weighs one-third of an ounce. The holster incorporates stretchable fabric, to provide the gripping force necessary to hold the holster with its attached spray, on a relaxed hand. The holster may be made of leather, with strips of stretchable fabric incorporated, to provide the gripping force necessary to retain the holster on the user's hand.

One prototype is made of a knitted, stretchable fabric. The stretch in the fabric measured at warp, is 185 percent. The stretch in the fabric, measured on the side, is 130 percent.

A holster with a grouped finger insertion hole 126, measuring three and one-half inches at rest, when expanded to four and one-half inches around the palm of a user's hand, exerts 40 ounces of retaining force. The force must be balanced in manufacture. Too much force, and the holster is difficult to put on, and the force is annoying to the user. Too little force, and the holster can be lost with a vigorous hand movement of a perspiration soaked hand.

Little finger encircling tube 212, and index finger encircling tube 210, measured at rest, one inch across, on the prototype, stretch to one and one-quarter inch when on a users hand, providing 16 ounces of retaining force.

The stretch of the material, retains the holster on the users hand, with no buttons, straps, or fasteners. The holster easily retains the container of repellent spray, in a completely relaxed hand, even while the hand is in motion, as the user jogs.

I claim:

1. An ambidextrous holster, for retaining a container of repellent, on either the left hand or the right hand of a user, comprising:

a container of repellent;

a hand encircling band of stretchable, elastic and porous fabric adapted to be disposed at least around part of the palm and back of the user's hand, short of the thumb, from the index finger to the little finger;

said hand encircling band having:

an index finger encircling tube formed in the same band of stretchable, elastic and porous fabric, extending from the web of the index finger, at the metacarpophalangeal joint, outwardly over the proximal phalanx, towards the middle phalanx, operable to prevent rotation of the band when a force is applied parallel to the band;

a middle finger and ring finger encircling tube formed in the same band of stretchable fabric operable to simultaneously encircle both middle finger and ring finger of the user's hand;

and a little finger encircling tube formed in the same band of stretchable fabric, extending from the web of the little finger, at the metacarpophalangeal joint, outwardly over the proximal phalanx towards the middle phalanx;

a retaining strap affixed to said hand encircling band, to retain said container of repellent between proximate the metacarpophalangeal joint of the fingers, and the proximal interphalangeal joint of the fingers;

said retaining strap comprising a band of material, transversely attached to an exterior palm side of the hand encircling band; said retaining strap configured to receive said container of repellent, to frictionally engage said container of repellent, said retaining strap further configured so that the retaining strap is open at both ends, at least one end adjacent to the thumb and index finger of the user; so that the holster is usable an be used on either hand by reversing the container of repellent.

2. An ambidextrous holster for retaining a container of repellent, on the hand of a user, comprising:

a container of repellent;

a hand encircling band of stretchable, porous and elastic fabric, adapted to be disposed around part of the palm and back of a user's hand, said band extending over a portion of the palm, short of the thumb, and operable through the stretch of the fabric, to retain the band, on a user's hand;

at least one index finger encircling tube formed in the band of stretchable elastic and porous fabric, said index finger encircling tube, extending from the web of the index finger, at the metacarpophalangeal joint, outwardly towards the middle phalanx;

said index finger encircling tube extending over, and encircling a portion of the index finger, towards the middle phalanx, whereby when a force is applied, parallel to the hand encircling band, the band is prevented from rotating around the hand, by the index finger encircling tube;

a retaining strap, affixed to an exterior the hand encircling band, at the palm side of the user, forming an open repellent retaining strap, said retaining strap being located, on the band so as to retain the container of repellent between proximate the thumb and index finger of a user, between the metacarpophalangeal joint and the proximal interphalangeal joint of the index finger.

3. An ambidextrous holster for retaining a container of repellent, on the hand of a user, comprising:

a hand encircling band of stretchable, elastic and porous fabric, for insertion on either hand of a user;

said hand encircling band having a first opening formed therethrough, for receiving four fingers of a user such that the band is located short of the thumb of the user;

said hand encircling band having a container of repellent affixed thereto by a retaining means;

said retaining means, formed on the external surface of the band, operable to retain the container of repellent:

between proximate the metacarpophalangeal joint of the index finger, and the proximal interphalangeal joint of the index finger;

adjacent to the thumb;

said hand encircling band having at least one index finger encircling tube formed therethrough; said index finger encircling tube, encircling the index finger of the user, after said band is mounted on the user's hand.

4. The holster, according to claim 3, including a second finger encircling tube, for encircling the little finger, said second finger encircling tube extending from the web of the little finger, outwardly from the metacarpophalangeal joint towards the middle phalanx of the little finger.

5. The holster, according to claim 3, including a second finger encircling tube, and a third finger encircling tube, for encircling the little finger and the middle finger and the ring finger, respectively, extending from the web of the hand, outwardly over the proximal phalanx towards the middle phalanx of the little finger, middle finger and the ring finger.

6. A holster, for a container of repellent, of the type including an elongated substantially cylindrical body, extending from a base end, to a manually operable actuator end, and adapted to be held between the metacarpophalangeal joints of the fingers and the proximal interphalangeal joint of the fingers adjacent to the palm of the hand, said holster comprising:

securing means comprised of an elongated elastic band, to be fitted over the hand, in an orientation:

laterally spanning the palmar and dorsal surfaces thereof;

adjacent the metacarpophalangeal joints;

short of the thumb;

extending outwardly from the metacarpophalangeal joints, operable to securely grip the hand and four fingers;

a retaining strap affixed to the elongated elastic band, adapted to hold the substantially cylindrical body of the repellent, across the hand, between proximate the metacarpophalangeal joints of the fingers, and the proximal interphalangeal joints of the fingers, adjacent to, and opposed from, the pad of the thumb, with the actuator end of the repellent, protruding clear of the retaining strap, and accessible by the thumb;

at least one elongated, elastic finger encircling tube, formed through the band, extending from the web of the index finger, at the hand, outwardly from the metacarpophalangeal joint towards the middle phalanx, operable to prevent rotation of the band when a force is applied parallel to the band.

* * * * *